US011065896B2

(12) United States Patent
Groepper

(10) Patent No.: US 11,065,896 B2
(45) Date of Patent: Jul. 20, 2021

(54) ARRANGEMENT WITH A RECEIPT PRINTER ARRANGED IN A HOUSING

(71) Applicant: Wincor Nixdorf International GmbH, Paderborn (DE)

(72) Inventor: Sascha Groepper, Geseke (DE)

(73) Assignee: Wincor Nixdorf International GmbH, Paderborn (DE)

( * ) Notice: Subject to any disclaimer, the term of this patent is extended or adjusted under 35 U.S.C. 154(b) by 91 days.

(21) Appl. No.: 16/256,539

(22) Filed: Jan. 24, 2019

(65) Prior Publication Data

US 2019/0224998 A1 Jul. 25, 2019

(30) Foreign Application Priority Data

Jan. 24, 2018 (DE) ..... 102018101552.6

(51) Int. Cl.
*G07G 5/00* (2006.01)
*B41J 29/13* (2006.01)
(Continued)

(52) U.S. Cl.
CPC ..... *B41J 29/13* (2013.01); *B41J 3/4075* (2013.01); *B41J 11/0045* (2013.01);
(Continued)

(58) Field of Classification Search
CPC ..... B65H 2511/164; B65H 2402/441; B41J 11/0055; B41J 15/042; B41J 29/13; B41J 11/0045; B41J 15/046; G07G 5/00
See application file for complete search history.

(56) References Cited

U.S. PATENT DOCUMENTS 6,068,419 A * 5/2000 Shiozaki ..... B41J 2/32 400/582
2011/0063399 A1 3/2011 Tsuchiya et al.
2020/0171812 A1* 6/2020 Samuelson ..... B41F 21/00

FOREIGN PATENT DOCUMENTS

DE 102010040177 A1 8/2012
EP 2211314 B1 12/2009
JP 2010143143 A 7/2010

OTHER PUBLICATIONS

Extended European Search Report corresponding European application; 7 pages.

(Continued)

*Primary Examiner* — Howard J Sanders
(74) *Attorney, Agent, or Firm* — Black, McCuskey, Souers & Arbaugh LPA

(57) ABSTRACT

An arrangement includes a receipt printer for printing a receipt arranged in a housing. The housing includes a pivoting lid which in an open state allows access to the receipt printer and in a closed state prevents access to the receipt printer. The lid has an opening through which a receipt printed by the receipt printer can be output in the closed state. The arrangement has a receipt output unit which in the closed state is arranged in the opening of the lid opposite to the receipt printer, at least a first receipt guiding unit and at least a first elastically deformable element for spring-mounting at least one component of the first receipt guiding unit. The receipt printer has a second receipt guiding unit. The first receipt guiding unit is engaged with the second receipt guiding unit when the lid is moved from the open state into the closed state.

14 Claims, 6 Drawing Sheets

(51) Int. Cl.
*B41J 11/00* (2006.01)
*B41J 15/04* (2006.01)
*B41J 3/407* (2006.01)

(52) U.S. Cl.
CPC ..... *B41J 15/042* (2013.01); *G07G 5/00* (2013.01); *B41J 15/046* (2013.01)

(56) References Cited

OTHER PUBLICATIONS

Office Action filed in the corresponding German application; 5 pages.

* cited by examiner

ARRANGEMENT WITH A RECEIPT PRINTER ARRANGED IN A HOUSING

CROSS-REFERENCE TO RELATED APPLICATIONS

This application claims priority to and the benefit of German Patent Application DE 10 2018 101 552.6 filed 24 Jan. 2018, the contents of which are hereby incorporated by reference in their entirety.

BACKGROUND AND SUMMARY

This relates to an arrangement with a receipt printer for printing a receipt, which receipt printer is arranged in a housing. The housing includes a pivoting lid which in an open state allows access to the receipt printer and in a closed state prevents access to the receipt printer. The lid has an opening through which a receipt printed by the receipt printer can be output in the closed state of the lid.

According to the prior art, when moving the lid from the open into the closed state, the opening of the lid has to be brought into a position opposite to the receipt printer so that a removal of the receipt printed by the receipt printer is possible. Due to shape and position tolerances, the position of the opening in relation to the receipt printer may change such that the receipt can no longer be output reliably through the opening. For example, the position of the opening in relation to the receipt printer may be vertically displaced by up to ±2 mm so that the receipt hits an inside of the lid upon output from the receipt printer and is bent away from the opening. A reliable output of the receipt is thus no longer given.

Document EP 2 211 314 B1 discloses an automated teller machine with a head module and a safe module. The head module includes a control panel, an input and removal compartment for the input and the removal of notes of value and a printer for the output of receipts. The control panel is pivotable about an axis of rotation in order to allow access to the components present in the head module. The head module further has a lock so that only an authorized user may gain access to the components present in the head module.

Document DE 10 2010 040 177 A1 discloses a vending or reverse vending machine with a housing having a door pivotable about an axis of rotation. The door can be opened for maintaining the components arranged in the housing. The door has a receipt output shaft for the output of a printed receipt.

In at least one embodiment, an arrangement includes a receipt printer arranged in a housing, in which a receipt printed by the receipt printer is reliably output.

In at least one embodiment, an arrangement has a receipt printer for printing a receipt, which receipt printer is arranged in a housing. The housing includes a lid preferably pivotable about an axis of rotation, which lid allows access to the receipt printer in an open state and prevents access to the receipt printer in a closed state. The lid has an opening through which a receipt printed by the receipt printer can be output in the closed state of the lid. The arrangement further has a receipt output unit which is arranged in the opening of the lid opposite to the receipt printer in the closed state of the lid. The receipt output unit has at least a first receipt guiding unit. Further, the receipt output unit has at least a first elastically deformable element for spring-mounting at least one component of the first receipt guiding unit. The receipt printer has a second receipt guiding unit. The first receipt guiding unit is brought into engagement with the second receipt guiding unit when the lid is moved from the open state into the closed state. By the arrangement according to at least one embodiment a reliable output of the receipt printed by the receipt printer is achieved.

Preferably, the receipt printed by the receipt printer is guided through the receipt output unit from the receipt printer arranged within the housing through the opening of the lid to an outside of the housing. For this, the first receipt guiding unit of the receipt output unit is engaged with the second receipt guiding unit of the receipt printer in the closed state of the lid so that a continuous guidance of the receipt is possible. When the lid is moved from the open into the closed state, the receipt output unit is brought into a position opposite to the receipt printer preferably on a circular path. By this movement, the first receipt guiding unit is engaged with the second receipt guiding unit. In doing so, due to the spring-mounting of at least one component of the receipt output unit in particular shape and position tolerances are compensated, as a result whereof a precise and reliable connection between the first receipt guiding unit and the second receipt guiding unit is possible.

In at least one embodiment, by way of spring-mounting at least one component of the receipt output unit, position tolerances which result in that the position of the lid or the position of the first receipt guiding unit of the receipt output unit in relation to the receipt printer is vertically displaced by up to 2 mm upward or downward are compensated.

It is advantageous, in at least one embodiment, when the first receipt guiding unit of the receipt output unit has a first guiding element and at least a second guiding element. For example, the first guiding element and the second guiding element may be arranged such that in case of proper use of the arrangement the second receipt guiding unit is at least partially arranged between the first guiding element and the second guiding element in the closed state of the lid. As a result thereof, in the closed state of the lid, the continuous transition between the first receipt guiding unit and the second receipt guiding unit is realized. In particular, the first guiding element and the second guiding element may be arranged movably to each other. As a result, shape and position tolerances may be compensated ever better when the lid is moved from the open into the closed state.

It is advantageous, in at least one embodiment, when the first guiding element and/or the second guiding element are each pivotably mounted about an axis of rotation relative to the lid. The pivoting movements of the first guiding element and the second guiding element, respectively, serve to compensate the shape and position tolerances when the lid is moved from the open into the closed state. A pivotable mounting of the first guiding element and/or the second guiding element each time about an axis of rotation is in addition particularly easy to implement.

It is advantageous, in at least one embodiment, when the first elastically deformable element is a pressure spring which, when the lid is moved from the open state into the closed state, presses the first guiding element against a first area of the second receipt guiding unit of the receipt printer allocated to the first guiding element. The first area of the second receipt guiding unit may in particular be a contact surface which is arranged opposite to the first guiding element in the closed state of the lid. As a result, it is prevented that between the second receipt guiding unit and the first guiding element a gap is formed through which the receipt could get out of the lead.

In at least one embodiment, preferably, the receipt output unit has a second elastically deformable element which connects the first guiding element and the second guiding element to each other. The second elastically deformable element connects the first guiding element and the second guiding element in particular such that these can be moved relative to each another within a certain tolerance range.

In at least one embodiment, preferably, the second elastically deformable element is a tension spring which presses the second guiding element against a second area of the second receipt guiding unit of the receipt printer allocated to the second guiding element when the lid is moved from the open state into the closed state. In particular, the first guiding element and the second guiding element may be arranged such that in case of proper use of the arrangement the first guiding element and the second guiding element surround the second receipt guiding unit in the closed state of the lid. As a result, a firm engagement and contact between the first receipt guiding unit formed by the first guiding element and the second guiding element and the second receipt guiding unit is possible.

It is advantageous, in at least one embodiment, when in the closed state of the lid the receipt is guided between the first guiding element and the second guiding element for the output from the arrangement. As a result, the path along which the receipt is guided is delimited in two directions, in particular upward and downward. This guarantees a reliable guidance of the receipt.

It is advantageous, in at least one embodiment, when the receipt output unit has a presentation unit for the output of the receipt, which presentation unit is arranged on an outside of the lid. In particular, the receipt is guided through the presentation unit along a bent path. This increases the stiffness of the receipt, as a result whereof the receipt can be moved more easily. Further, it can thus be prevented that damage and/or manipulation of the receipt printer, for example with the aid of a rigid, pointed object may be caused. While a receipt is usually flexible and can thus be guided along the bent path, this path is blocked for a rigid object.

It is advantageous, in at least one embodiment, when the first guiding element and/or the second guiding element are each arranged on the presentation unit so as to be pivotable about an axis of rotation. In particular, the presentation unit is arranged on the lid so that the first guiding element and/or the second guiding element are each arranged on the lid so as to be pivotable about an axis of rotation. The pivoting movements of the first guiding element and of the second guiding element, respectively, in turn compensate the tolerances when the lid is moved from the open into the closed state.

Preferably, the presentation unit includes a first guiding section and a second guiding section. In the closed state of the lid, the receipt is guided for the output from the arrangement between the first guiding section and the second guiding section. The use of the two guiding sections enables an easy manufacture and assembly of the presentation unit.

Apart from the receipt printer, the housing may also include further components, such as a reading unit for magnetic cards, a control unit for controlling sequences of the arrangement and/or an input/output compartment for notes of value and/or coins.

On an outside of the lid, an input unit, such as a keyboard, and/or an output unit, such as a screen, may be arranged.

The arrangement can in particular be a self-service machine, such as an automated teller machine, a cash register system, a reverse vending machine or a lottery terminal.

It is advantageous, in at least one embodiment, when the receipt output unit completely covers the opening of the lid so that in the closed state of the lid no access to the receipt printer and/or other components arranged within the housing is possible.

Various aspects will become apparent to those skilled in the art from the following detailed description and the accompanying drawings.

DETAILED DESCRIPTION

Figure 1:
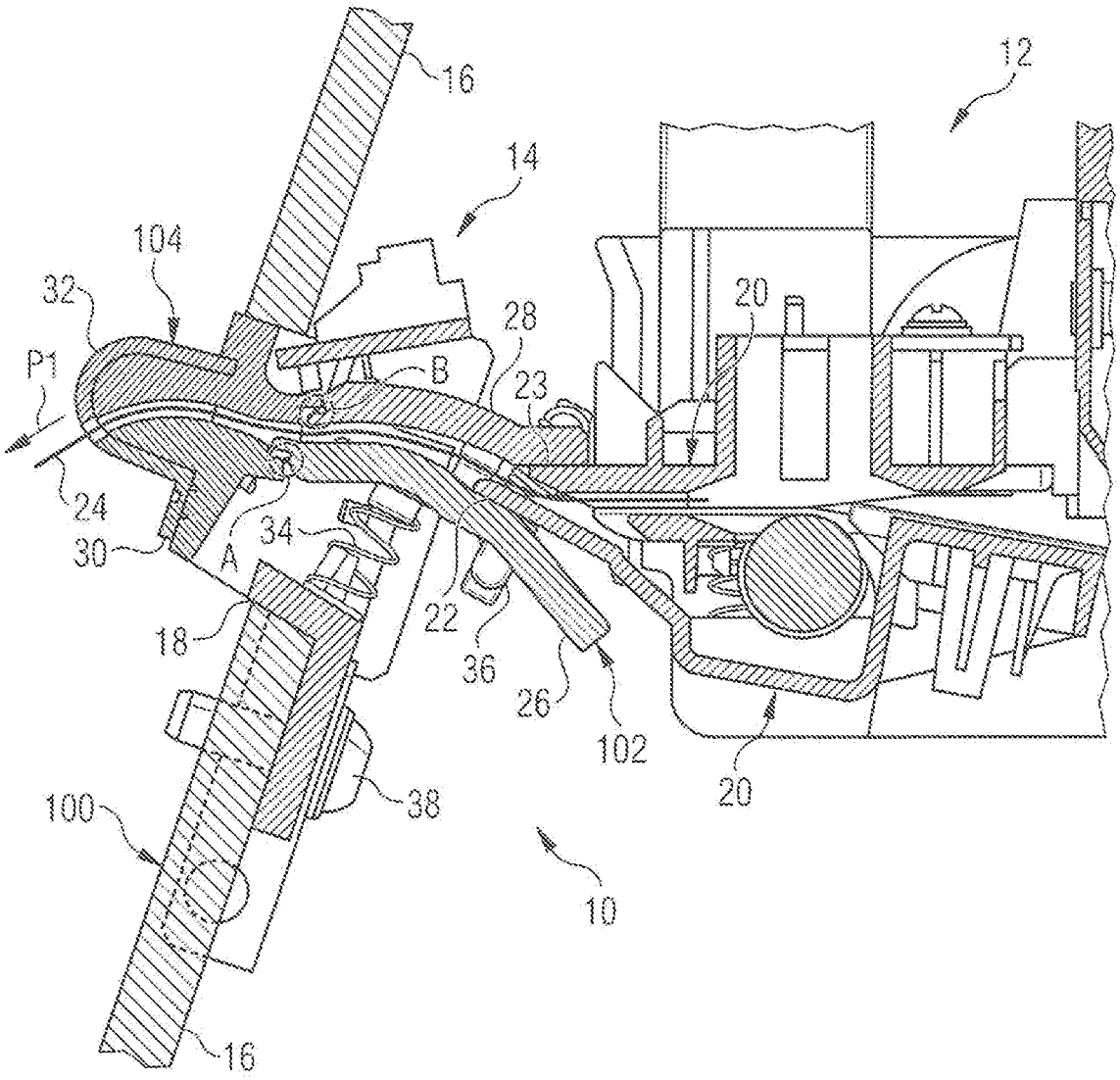
FIG. 1 shows a sectional view of an arrangement with a receipt printer for printing a receipt arranged in a housing and with a receipt output unit according to one embodiment.

Referring now to the drawings, FIG. 1 shows a sectional view of an arrangement 10 with a receipt printer 12 for printing a receipt 24 arranged in a housing 100 and with a receipt output unit 14 having a first receipt guiding unit 102 according to one embodiment. For the output, the receipt 24 is moved through the arrangement 10 in the direction of the arrow P1, i.e. to the left in FIG. 1. The position of the receipt 24 in FIG. 1 merely serves to illustrate the path along which the receipt 24 is guided through the arrangement 10 and is to be understood only as an example.

The housing 100 has a lid 16 pivotable about an axis of rotation. The lid 16 has an open state in which access to the inside of the housing 100, in particular to the receipt printer 12 is possible, and a closed state in which access to the inside of the housing 100 is prevented. FIG. 1 shows the lid 16 in the closed state. The lid 16 further has an opening 18 through which the receipt 24 can be output in the closed state of the lid 16.

In the closed state of the lid 16, the receipt printer 12 is arranged opposite to the opening 18. On a side of the receipt printer 12 facing the opening 18, a second receipt guiding unit 20 is arranged through which the receipt 24 is output from the receipt printer 12. The second receipt guiding unit 20 has a first area 22 which is arranged below the receipt 24, and a second area 23 which is arranged above the receipt 24. By the first area 22 and the second area 23 the path along which the receipt 24 is guided is delimited upward and downward.

The receipt output unit 14 is arranged in the opening 18 of the lid 16 and is fixed to the lid 16 by two screws 38, of which only one is illustrated in FIG. 1. When moving the lid 16 from the open into the closed state, the receipt output unit 14 describes a circular path. The receipt output unit 14 has the first receipt guiding unit 102 and a presentation unit 104 for outputting the receipt 24 on an outside of the housing 100. The first receipt guiding unit 102 is arranged on the side of the receipt output unit 14 facing the receipt printer 12, i.e. in the direction of the interior of the housing 100, and includes a first guiding element 26 and a second guiding element 28. The presentation unit 104 is arranged on the side of the receipt output unit 14 facing away from the receipt printer 12 and includes a first guiding section 30 and a second guiding section 32.

The first guiding element 26 and the first guiding section 30 are arranged below the receipt 24. The second guiding element 28 and the second guiding section 32 are arranged above the receipt 24. The first guiding element 26 is pivotably mounted about a first axis of rotation A, which lies below the receipt 24 in the illustration of FIG. 1, on the first guiding section 30. The second guiding element 28 is pivotably mounted about a second axis of rotation B, which lies above the receipt 24 in the illustration of FIG. 1, on the second guiding section 32. By the first guiding section 30 and the second guiding section 32 a bent path (or a so-called meandering) is formed along which the receipt 24 is guided.

The receipt output unit 14 further has a pressure spring 34 which elastically connects the first guiding element 26 and the first guiding section 30. The pressure spring 34 is arranged such that in the closed state of the lid 16 the first guiding element 26 is pressed from below against the first area 22 of the second receipt guiding unit 20. The first guiding element 26 and the second guiding element 28 are connected to each other by two tension springs 36, of which only one is illustrated in FIG. 1, such that the first guiding element 26 and the second guiding element 28 are pressed against each other. Hereby, in the closed state of the lid 16, the second guiding element 28 is pressed from above against the second area 23 of the second receipt guiding unit 20. The receipt output unit 14 is still described in more detail further below in connection with FIGS. 2 to 7.

Figure 2:
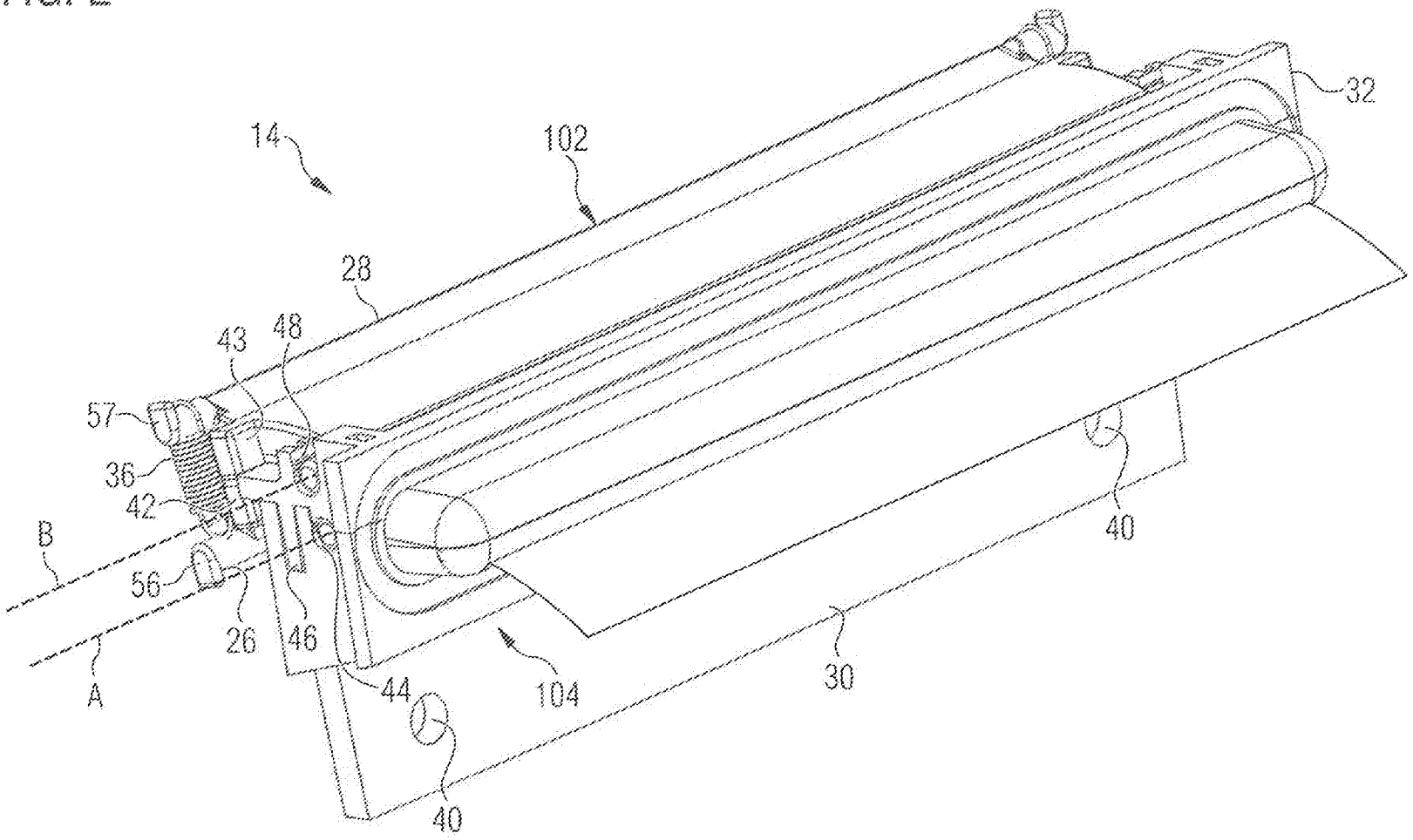
FIG. 2 shows a perspective illustration of the receipt output unit for outputting the receipt from the arrangement according to the embodiment of FIG. 1.

FIG. 2 shows the receipt output unit 14 for outputting the receipt 24 from the arrangement 10 according to the embodiment of FIG. 1. The receipt output unit 14 includes the first receipt guiding unit 102 and the presentation unit 104. The position of the receipt 24 in FIG. 2 is to be understood only as an example.

The first receipt guiding unit 102 has the first guiding element 26 and the second guiding element 28. The first guiding element 26 is pivotably mounted about the first axis of rotation A. The first guiding element 26 has, at two ends laterally next to the receipt 24, two first spring holding elements 56, of which only one is illustrated in FIG. 2 and at each of which one of the two tension springs 36 is mounted, and first spacer elements 42 which are each arranged between one of the two first spring holding elements 56 and the first axis of rotation A. The second guiding element 28 is pivotably mounted about the second axis of rotation B. The second guiding element 28 has, at two ends laterally next to the receipt 24, two second spring holding elements 57, of which only one is illustrated in FIG. 1 and at each of which one of the two tension springs 36 is mounted, and second spacer elements 43 which are each arranged between one of the two second spring holding elements 57 and the first axis of rotation A. The first guiding element 26 and the second guiding element 28 are connected to each other by the two tension springs 36. The tension springs 36 are biased such that the first spacer elements 42 and the second spacer elements 43 are pressed against each other.

The presentation unit 104 includes the first guiding section 30 and the second guiding section 32. In the mounted state, the first guiding section 30 has holes 40 extending toward the lid 16, through which screws 38 can be passed in order to connect the first guiding section 30 to the lid 16. The first guiding section 30 has first recesses 44 which are arranged on the first axis of rotation A each time laterally next to the receipt 24 and in which the first guiding element 26 is arranged pivotably about the first axis of rotation A. The second guiding section 32 has second recesses 48 which are arranged on the second axis of rotation B each time laterally next to the receipt 24 and in which the second guiding element 28 is arranged pivotably about the second axis of rotation B. The second guiding section 32 further has snap-in elements 46 arranged laterally next to the receipt 24 and by which the first guiding section 30 and the second guiding section 32 are connectable to each other.

Figure 3:
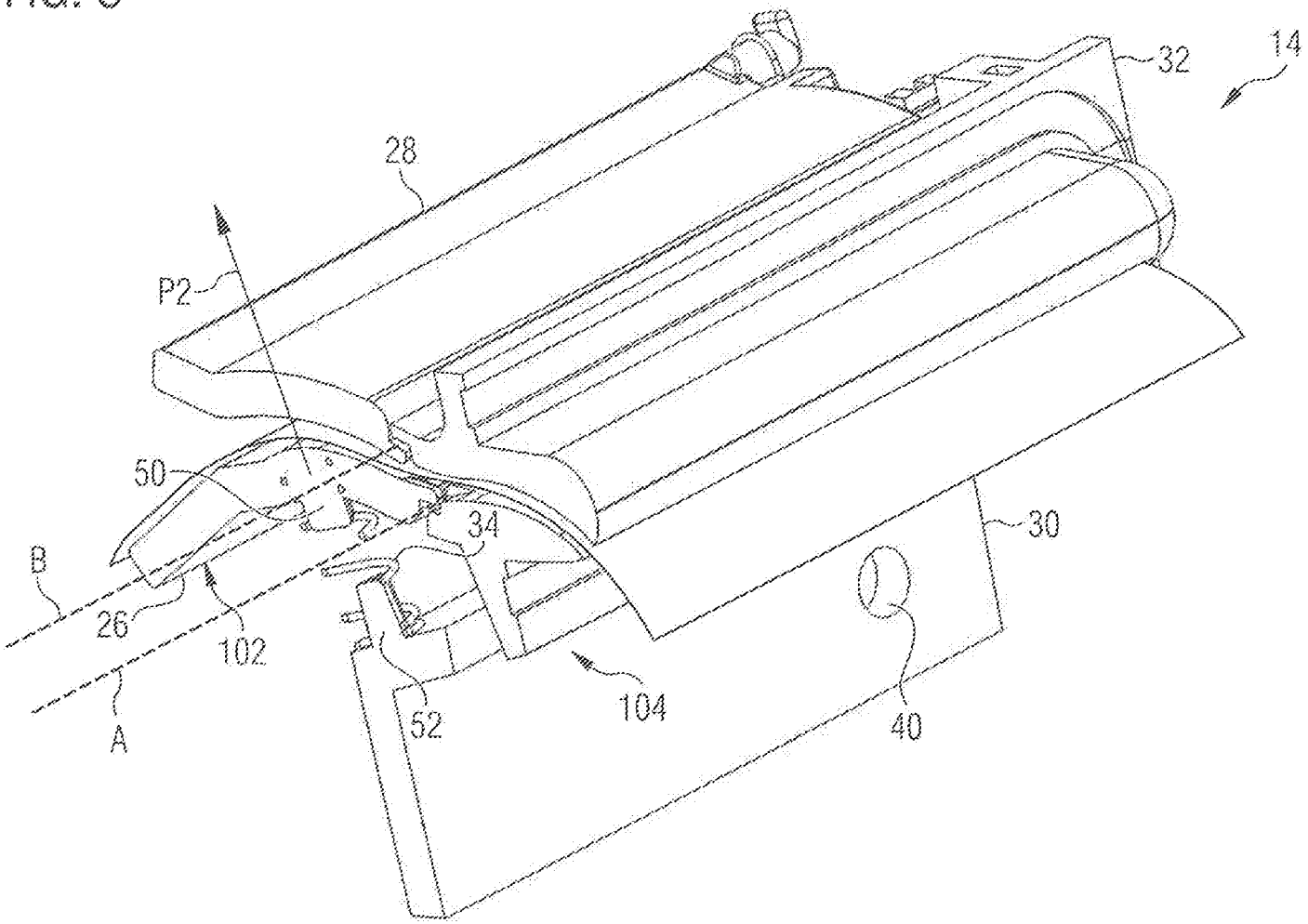
FIG. 3 shows a perspective sectional view of the receipt output unit according to the embodiment of FIG. 1.

FIG. 3 shows a perspective sectional view of the receipt output unit 14 according to the embodiment of FIG. 1. The receipt output unit 14 includes the first receipt guiding unit 102 and the presentation unit 104. The first receipt guiding unit 102 has the first guiding element 26 and the second guiding element 28. The first guiding element 26 has a first projection 50 which points away from the receipt 24, i.e. downward in FIG. 3, and onto which the pressure spring 34 is placed. The presentation unit 102 includes the first guiding section 30 and the second guiding section 32. The first guiding section 30 has a second projection 52 which points in the direction of the receipt 24, i.e. upward in FIG. 3, and onto which the pressure spring 34 is placed. Since the first guiding section 30 is firmly connectable to the lid 16, the pressure spring 34 presses the first guiding element 26 in the direction of the arrow P2, i.e. upward in FIG. 3.

Figure 4:
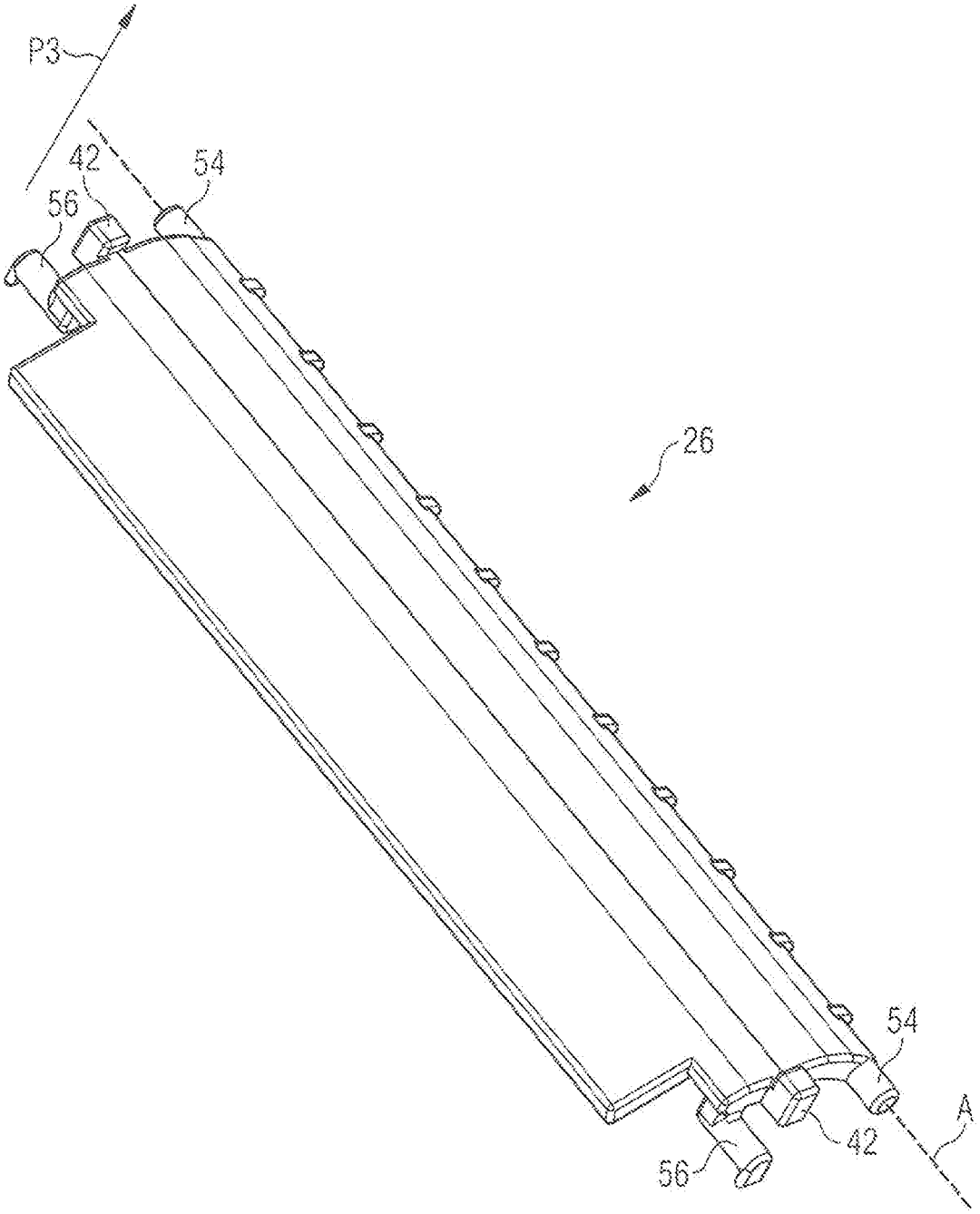
FIG. 4 shows a first guiding element of the receipt output unit according to the embodiment of FIG. 1.

FIG. 4 shows the first guiding element 26 of the receipt output unit 14 according to the embodiment of FIG. 1. In the illustration of FIG. 4, the receipt 24 is guided above the first guiding element 26. The first guiding element 26 has two first pivot point elements 54 which are arranged on the first axis of rotation A and about which the first guiding element 26 is pivotably mounted. The first guiding element 26 further has the two spring holding elements 56, at which the tension springs 36 are fixable. In the mounted state, the first guiding element 26 is pivoted by the tension springs 36 about the first axis of rotation A in the direction of the arrow P3, i.e. upward in FIG. 4.

Figure 5:
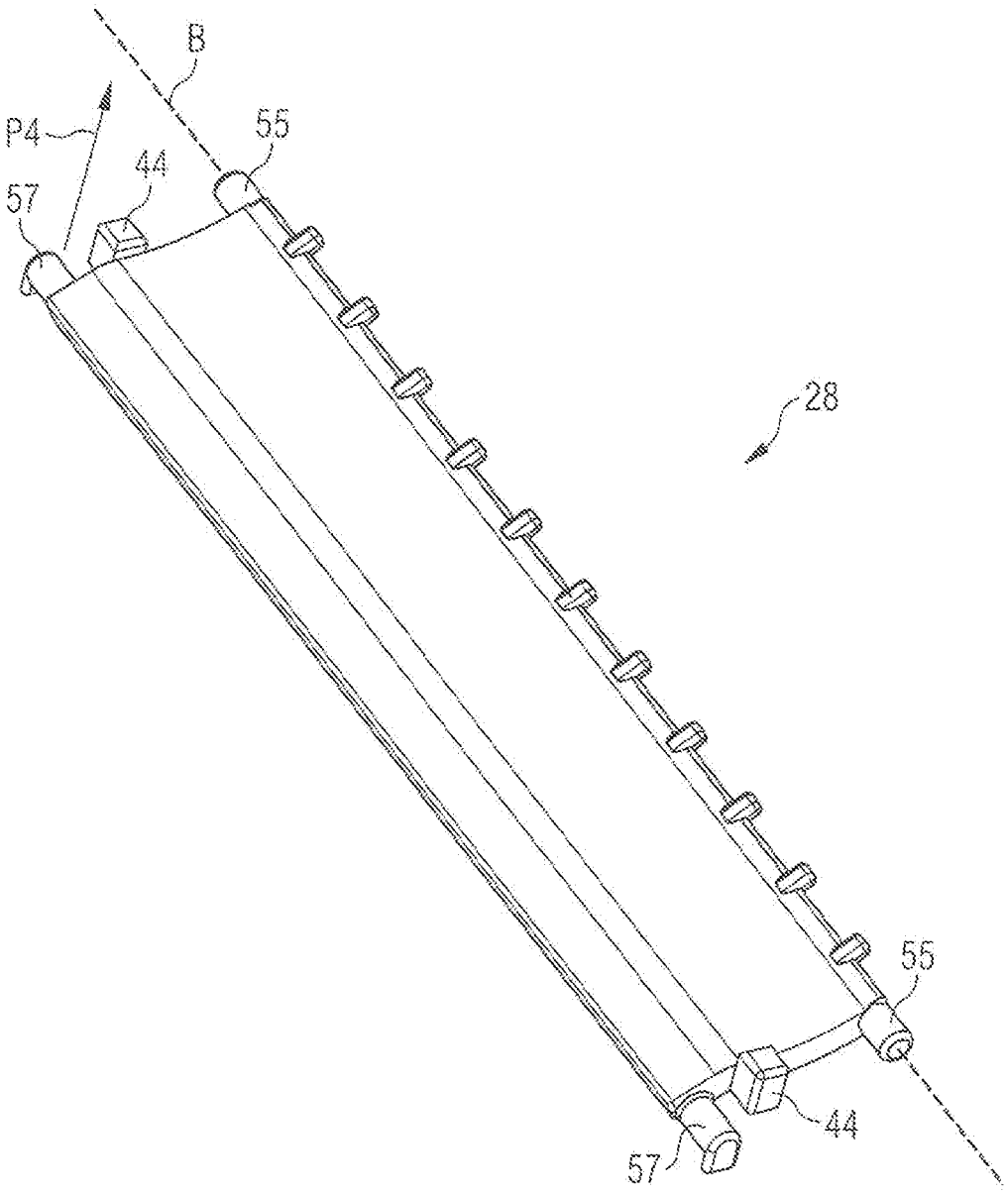
FIG. 5 shows a second guiding element of the receipt output unit according to the embodiment of FIG. 1.

FIG. 5 shows the second guiding element 28 of the receipt output unit 14 according to the embodiment of FIG. 1. In the illustration of FIG. 5, the receipt 24 is guided above the second guiding element 28. The second guiding element 28 has two second pivot point elements 55 which are arranged on the second axis of rotation B and about which the second guiding element 28 is pivotably mounted. The second guiding element 28 further has the two spring holding elements 57, at which the tension springs 36 are fixed. In the mounted state, the second guiding element 28 is pivoted by the tension springs 36 about the second axis of rotation B in the direction of the arrow P4, i.e. upward in FIG. 5.

Figure 6:
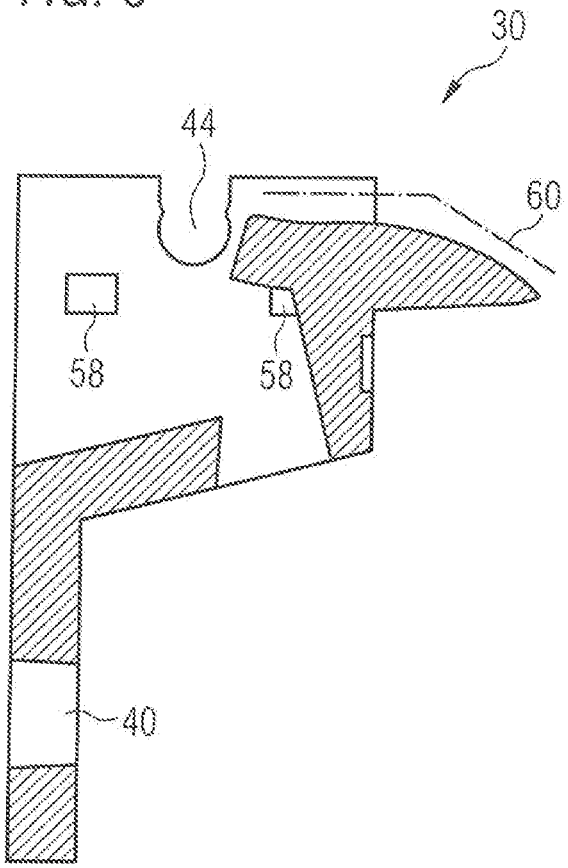
FIG. 6 shows a sectional view of a first guiding section of the receipt output unit according to the embodiment of FIG. 1.

FIG. 6 shows a sectional view of the first guiding section 30 of the receipt output unit 14 according to the embodiment of FIG. 1. The path along which the receipt 24 is guided through the arrangement 10 is indicated in FIG. 6 by the first broken line 60 and substantially lies above the first guiding section 30. As this is well visible in FIG. 6, the first guiding section 30 has the holes 40 through which the screws 38 can be passed in order to connect the first guiding section 30 to the lid 16, and the first recesses 44 in which in case of proper use of the arrangement 10 the first pivot point elements 54 of the first guiding element 26 are arranged such that the first guiding element 26 is pivotable about the first axis of rotation A. The first guiding section 30 further has snap-in holes 58 which are arranged below the path (broken line 60) and into which the snap-in elements 46 of the second guiding section 32 snap to connect the first guiding section 30 and the second guiding section 32 to each other.

Figure 7:
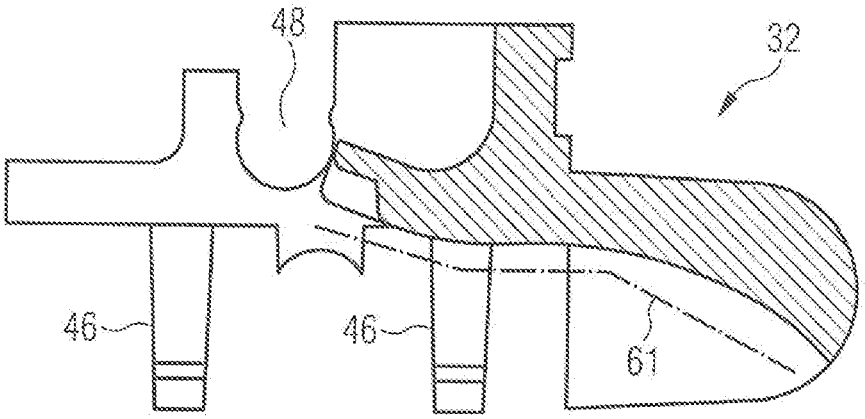
FIG. 7 shows a sectional view of a second guiding section of the receipt output unit according to the embodiment of FIG. 1.

FIG. 7 shows a sectional view of the second guiding section 32 of the receipt output unit 14 according to the embodiment of FIG. 1. The path along which the receipt 24 is guided through the arrangement 10 is indicated in FIG. 7 by a second broken line 61 and substantially lies below the guiding section 32. As this is well visible in FIG. 7, the second guiding section 32 has the second recesses 48 in which in case of proper use of the arrangement 10 the second pivot point elements 55 of the second guiding element 28 are arranged such that the second guiding element 28 is pivotable about the second axis of rotation B, and the snap-in elements 46 which snap into the snap-in holes 58 of the first guiding section 30 in order to connect the first guiding section 30 and the second guiding section 32 to each other.

While principles and modes of operation have been explained and illustrated with regard to particular embodiments, it must be understood, however, that this may be practiced otherwise than as specifically explained and illustrated without departing from its spirit or scope.

What is claimed is:

1. An arrangement comprises:

a housing with a receipt printer arranged therein, wherein the housing includes a pivotable lid which in an open state allows access to the receipt printer and in a closed state prevents access to the receipt printer, wherein the lid has an opening through which a receipt printed by the receipt printer can be output in the closed state of the lid, and a receipt output unit which in the closed state of the lid is arranged in the opening of the lid opposite to the receipt printer, the receipt output unit having at least a first receipt guiding unit, a presentation unit for output of the receipt, at least a first elastically deformable element for spring-mounting at least one component of the first receipt guiding unit, and a second receipt guiding unit, wherein the first receipt guiding unit is engaged with the second receipt guiding unit when the lid is moved from the open state into the closed state, wherein the second receipt guiding unit has a first area and a second area that delimit a receipt path along which the receipt is guided, such that the first area is arranged below the receipt, and the second area is arranged above the receipt and wherein the second receipt guiding unit is disposed between the first receipt guiding unit and the receipt printer;

wherein the presentation unit is arranged on an outside of the lid, and wherein the presentation unit has a convex surface protruding from the lid.

2. The arrangement according to claim 1, where the first receipt guiding unit of the receipt output unit has a first guiding element and at least a second guiding element, the first guiding element having a first end and an opposite second end, the first and second ends positioned lateral to the receipt path, and the at least second guiding element having a third end and an opposite fourth end, the third and fourth ends positioned lateral to the receipt path, wherein the first end of the first guiding element and the third end of the at least second guiding element are arranged on the same side of the receipt path, and the second end of the first guiding element and the fourth end of the at least second guiding element are arranged on the same side of the receipt path.

3. The arrangement according to claim 2, where at least one of the first guiding element and the second guiding element is arranged pivotably relative to the lid about an axis of rotation.

4. The arrangement according to claim 2, where the first elastically deformable element is a tension spring which presses the first guiding element against the first area of the second receipt guiding unit of the receipt printer allocated to the first guiding element when the lid is moved from the open state into the closed state.

5. The arrangement according to claim 2, where in the closed state of the lid the receipt is guided between the first guiding element and the second guiding element for the output from the arrangement.

6. The arrangement according to claim 2, where the first guiding element further comprises a first pivot point disposed at the first end and a second pivot point disposed at the second end, and the at least second guiding element further comprises a third pivot point disposed at the third end and a fourth pivot point disposed at the fourth end.

7. The arrangement according to claim 6, where the first guiding element and the second guiding element are arranged on the presentation unit so as to be pivotable about an axis of rotation defined by a first axis extending between the first pivot point and the second point, and a second axis extending between the third pivot point and the fourth pivot point respectively.

8. The arrangement according to claim 7, where the presentation unit includes a first guiding section and a second guiding section, where in the closed state of the lid the receipt is guided between the first guiding section and the second guiding section for output from the arrangement.

9. The arrangement according to claim 1, wherein the position of the receipt printer in relation to the second receipt guiding unit is the same for the open state and the closed state.

10. An arrangement comprises:

a housing with a receipt printer arranged therein, wherein the housing includes a pivotable lid which in an open state allows access to the receipt printer and in a closed state prevents access to the receipt printer, wherein the lid has an opening through which a receipt printed by the receipt printer can be output in the closed state of the lid, and a receipt output unit which in the closed state of the lid is arranged in the opening of the lid opposite to the receipt printer, the receipt output unit having at least a first receipt guiding unit, a presentation unit for output of the receipt, at least a first elastically deformable element for spring-mounting at least one component of the first receipt guiding unit, and a second receipt guiding unit, wherein the first receipt guiding unit is engaged with the second receipt guiding unit when the lid is moved from the open state into the closed state, wherein the second receipt guiding unit has a first area and a second area that delimit a receipt path along which the receipt is guided, such that the first area is arranged below the receipt, and the second area is arranged above the receipt and wherein the second receipt guiding unit is disposed between the first receipt guiding unit and the receipt printer;

where the first receipt guiding unit of the receipt output unit has a first guiding element and at least a second guiding element, the first guiding element having a first end and an opposite second end, the first and second ends positioned lateral to the receipt path, and the at least second guiding element having a third end and an opposite fourth end, the third and fourth ends positioned lateral to the receipt path, wherein the first end of the first guiding element and the third end of the at least second guiding element are arranged on the same side of the receipt path, and the second end of the first guiding element and the fourth end of the at least second guiding element are arranged on the same side of the receipt path where the first guiding element further comprises a first pivot point disposed at the first end and a second pivot point disposed at the second end, and the at least second guiding element further comprises a third pivot point disposed at the third end and a fourth pivot point disposed at the fourth end;

where the first guiding element and the second guiding element are arranged on the presentation unit so as to be pivotable about an axis of rotation defined by a first axis extending between the first pivot point and the second point, and a second axis extending between the third pivot point and the fourth pivot point respectively;

where the presentation unit includes a first guiding section and a second guiding section, where in the closed state of the lid the receipt is guided between the first guiding section and the second guiding section for output from the arrangement;

where the first guiding section has a first recess and a second recess, and where the second guiding section has a third recess and a fourth recess, wherein the first pivot point is arranged in the first recess, wherein the second pivot point is arranged in the second recess, wherein the third pivot point is arranged in the third recess, and wherein the fourth pivot point is arranged in the fourth recess.

11. An arrangement comprises:

a housing with a receipt printer arranged therein, wherein the housing includes a pivotable lid which in an open state allows access to the receipt printer and in a closed state prevents access to the receipt printer, wherein the lid has an opening through which a receipt printed by the receipt printer can be output in the closed state of the lid, and a receipt output unit which in the closed state of the lid is arranged in the opening of the lid opposite to the receipt printer, the receipt output unit having at least a first receipt guiding unit, a presentation unit for output of the receipt, at least a first elastically deformable element for spring-mounting at least one component of the first receipt guiding unit, and a second receipt guiding unit, wherein the first receipt guiding unit is engaged with the second receipt guiding unit when the lid is moved from the open state into the closed state, wherein the second receipt guiding unit has a first area and a second area that delimit a receipt path along which the receipt is guided, such that the first area is arranged below the receipt, and the second area is arranged above the receipt and wherein the second receipt guiding unit is disposed between the first receipt guiding unit and the receipt printer;

where the first receipt guiding unit of the receipt output unit has a first guiding element and at least a second guiding element, the first guiding element having a first end and an opposite second end, the first and second ends positioned lateral to the receipt path, and the at least second guiding element having a third end and an opposite fourth end, the third and fourth ends positioned lateral to the receipt path, wherein the first end of the first guiding element and the third end of the at least second guiding element are arranged on the same side of the receipt path, and the second end of the first guiding element and the fourth end of the at least second guiding element are arranged on the same side of the receipt path where the first guiding element further comprises a first spring holding element disposed at the first end and a second spring holding element disposed at the second end, and where the at least second guiding element further comprises a third spring holding element disposed at the third end and a fourth spring holding element disposed at the fourth end.

12. The arrangement according to claim 11, where the receipt output unit has a plurality of a second elastically deformable element which connects the first guiding element and the second guiding element to each other, wherein a first of the plurality of the second elastically deformable element mounts to the first spring holding element of the first guiding element and the third spring holding element of the at least second guiding element, and wherein a second of the plurality of the second elastically deformable element mounts to the second spring holding element of the first guiding element and the fourth spring holding element of the at least second guiding element.

13. The arrangement according to claim 12, where the second elastically deformable element is a tension spring which presses the second guiding element against the second area of the second receipt guiding unit of the receipt printer allocated to the second guiding element when the lid is moved from the open state into the closed state.

14. The arrangement according to claim 12, where the first guiding element further comprises a first spacer element disposed on the first lateral end and a second spacer element disposed on the second lateral end, and where the at least second guiding element further comprises a third spacer element disposed on the first lateral end and a fourth spacer element disposed on the second lateral end, wherein the first spacer element of the first guiding element and the third spacer element of the at least second guiding element are pressed together, and the second spacer element of the first guiding element and the fourth spacer element of the at least second guiding element are pressed together.

* * * * *